US011486567B2

(12) United States Patent
Kim

(10) Patent No.: US 11,486,567 B2
(45) Date of Patent: Nov. 1, 2022

(54) INCANDESCENT BULB-TYPE LED LAMP HAVING HEAT DISSIPATION FUNCTION

(71) Applicant: JK Lighting Co., Ltd, Yongin-si (KR)

(72) Inventor: Hak Sil Kim, Yongin-si (KR)

(73) Assignee: JK Lighting Co., Ltd, Yongin-si (KR)

( * ) Notice: Subject to any disclaimer, the term of this patent is extended or adjusted under 35 U.S.C. 154(b) by 3 days.

(21) Appl. No.: 17/305,208

(22) Filed: Jul. 1, 2021

(65) Prior Publication Data

US 2021/0396380 A1 Dec. 23, 2021

Related U.S. Application Data

(63) Continuation of application No. PCT/KR2021/007448, filed on Jun. 15, 2021.

(30) Foreign Application Priority Data

Jun. 18, 2020 (KR) ..... 10-2020-0073991

(51) Int. Cl.
*F21V 29/70* (2015.01)
*F21K 9/235* (2016.01)
(Continued)

(52) U.S. Cl.
CPC ..... *F21V 29/70* (2015.01); *F21K 9/232* (2016.08); *F21K 9/235* (2016.08); *F21K 9/237* (2016.08); *F21V 23/023* (2013.01); *F21V 29/85* (2015.01)

(58) Field of Classification Search
CPC ..... F21K 9/232; F21K 9/235; F21K 9/237; F21V 29/70; F21V 29/85
See application file for complete search history.

(56) References Cited

U.S. PATENT DOCUMENTS

2013/0271987 A1* 10/2013 Hussell ..... F21V 29/85 362/249.02
2013/0271990 A1* 10/2013 Hussell ..... F21K 9/232 362/249.02
(Continued)

FOREIGN PATENT DOCUMENTS

CN 203549432 U * 4/2014 ..... F21V 3/061
CN 204127691 U * 1/2015 ..... F21K 9/232
(Continued)

OTHER PUBLICATIONS

Office Action in Korean Application No. 1020200073991 dated Sep. 28, 2021 and English Summary in 5 pages.
(Continued)

*Primary Examiner* — Anabel Ton
(74) *Attorney, Agent, or Firm* — Knobbe Martens Olson & Bear LLP

(57) ABSTRACT

This application relates to an incandescent bulb-type LED lamp having a heat dissipation function. In one aspect, the LED lamp includes a globe forming an external shape of the lamp, and an LED module supported by a stem in which a gas injection portion is formed and installed inside the globe. The LED lamp may also include a power supply unit for supplying power to the LED module, and a base bonded to one side of the globe and connected to a socket to supply commercial power to the power supply unit. The LED lamp may further include a heat conduction member filled in an internal space formed by an inner surface of the base and a printed circuit board (PCB) of the power supply unit and configured to dissipate heat generated from the LED module and the power supply unit to the outside through the base.

4 Claims, 6 Drawing Sheets

(a)

(b)

(51) Int. Cl.

| | |
|---|---|
| ***F21V 29/85*** | (2015.01) |
| ***F21K 9/237*** | (2016.01) |
| ***F21K 9/232*** | (2016.01) |
| ***F21V 23/02*** | (2006.01) |

(56) References Cited

U.S. PATENT DOCUMENTS

| | | | | |
|---|---|---|---|---|
| 2013/0301252 | A1 | 11/2013 | Hussel et al. | |
| 2019/0195431 | A1* | 6/2019 | Chen | F21V 3/02 |

FOREIGN PATENT DOCUMENTS

| | | | | |
|---|---|---|---|---|
| KR | 10-0986170 | B1 | 10/2010 | |
| KR | 10-1032415 | B1 | 4/2011 | |
| KR | 10-2011-0122484 | A | 11/2011 | |
| KR | 10-2014-0105255 | A | 9/2014 | |
| KR | 10-2018-0000816 | A | 1/2018 | |
| WO | WO-2012031533 | A1 * | 3/2012 | F21V 19/003 |

OTHER PUBLICATIONS

International Search Report and Written Opinion for PCT Application No. PCT/KR2021/007448, dated Sep. 24, 2021 in 9 pages.

* cited by examiner (b)

(a)

INCANDESCENT BULB-TYPE LED LAMP HAVING HEAT DISSIPATION FUNCTION

CROSS-REFERENCE TO RELATED APPLICATIONS

This application is a continuation application, and claims the benefit under 35 U.S.C. § 120 and § 365 of International Application No. PCT/KR2021/007448, filed on Jun. 15, 2021, which claims the benefit of Korean Patent Application No. 10-2020-0073991 filed on Jun. 18, 2020, in the Korean Intellectual Property Office, the entire disclosure of each of which is incorporated herein by reference.

BACKGROUND

Technical Field

The present disclosure relates to a light emitting diode (LED) lamp, and more particularly, to an incandescent bulb-type LED lamp having a heat dissipation function to increase durability of the LED lamp by efficiently dissipating heat generated from an LED module and a PCB substrate inside a glass sphere or a plastic sphere formed in an incandescent bulb structure to the outside.

Description of Related Technology

In a general incandescent bulb, electric current flows through a filament made of tungsten to emit heat and light to brighten or warm the surroundings. The inside of the lamp may be filled with a single or mixed gas of helium, argon, and nitrogen to increase durability of the tungsten filament, thereby maintaining the lamp's life span for a long time. The incandescent bulb has an external shape made of glass or plastic material that is integrally formed, and a gas inlet for filling the inside of the incandescent bulb with the mixed gas extends from the external shape. The external shape of the incandescent bulb may include an R type, an elliptical reflection type, a PAR type, a bowl reflection type, and the like, depending on the purpose of using light according to a light distribution direction as indirect lighting by focusing or spreading the light according to the light distribution direction.

The incandescent bulb injects a predetermined gas through the gas inlet and then seals the gas inlet so that the inside thereof is completely blocked from outside air. The incandescent bulb has a base electrically connected to a socket, and the base may supply electricity to the filament through a + lead-in wire and a − lead-in wire for applying external power through a stem.

Meanwhile, in recent years, an LED lamp using an LED module that may save energy and create a variety of indoor and outdoor lighting interiors has been manufactured. Although the LED lamp maintains a long lifespan, a desired life time of the LED lamp is significantly reduced by the heat generated from the LED module and a power supply for supplying power to the LED module.

SUMMARY

An object of the present disclosure is to provide an incandescent bulb-type LED lamp having a heat dissipation function to increase the durability of the LED lamp by efficiently dissipating heat generated from an LED module and an LED substrate inside a glass sphere or a plastic sphere formed in an incandescent bulb structure to the outside.

According to an exemplary embodiment of the present disclosure, there is provided an incandescent bulb-type LED lamp having a heat dissipation function including: a globe forming an external shape of the lamp; an LED module supported by a stem in which a gas injection portion is formed and installed inside the globe; a power supply unit for supplying electricity to the LED module; a base that is bonded to one side of the globe and connected to a socket to supply commercial power to the power supply unit; and a heat conduction member that is filled in an internal space formed by an inner surface of the base and a printed circuit board (PCB) of the power supply unit and configured to dissipate heat generated from the LED module and the power supply unit to the outside through the base.

The heat conduction member may be made of heat dissipating silicon.

The heat conduction member may be injected through an opening formed in an upper portion of the base after the base is bonded to the globe.

The printed circuit board (PCB) of the power supply unit may be formed with a gas injection hole into which the gas injection portion is inserted, and a sealing member may be inserted between the gas injection portion and the gas injection hole of the printed circuit board (PCB).

The incandescent bulb-type LED lamp may further include an insulating sheet for supporting a + wire and a − wire between the power supply unit and a bonding surface, wherein a hole into which the gas injection portion is inserted is formed in the center of the insulating sheet, and one or more cut-out lines are formed in predetermined directions from the hole, so that a cut-out plate is attached to an outer surface of the gas injection portion while the gas injection portion is inserted into the hole.

According to the present disclosure as described above, by filling the internal space S with the heat conduction member in order to maximally dissipate the heat generated from the LED module and the power supply through the base by heat conduction rather than thermal convection, the heat generated from the LED lamp of the sealed structure may be efficiently dissipated to the outside, thereby improving the durability of the LED lamp.

Further, the production cost may be reduced by not using the heat dissipation device such as an expensive aluminum heatsink in a part of the existing globe, and since the production equipment for manufacturing the conventional incandescent bulb including the globe, stem and base may be used as it is, additional process costs may not incur, thereby improving the production efficiency.

DETAILED DESCRIPTION

In relation to heat dissipation of the LED lamp, "Radial type radiator and LED lighting apparatus of bulb type using the same" of Korean Patent No. 10-1032415 is disclosed. In the related art, a heat dissipation device having a plurality of heat dissipation fins for dissipating heat conducted from an LED package through a body formed on a cylindrical portion and a flange portion of the body in order to dissipate the heat generated from an LED module and a power supply unit is formed. However, the heat dissipation device is connected between a globe and a screw cap and has an external shape divided into three parts, which are mutually fitted or screwed together, and as a result, the cost of manufacturing the heat dissipation device is added, and the product cost is inevitably high.

Therefore, it is necessary to develop a new LED lamp that may improve the durability of the LED lamp by arranging the LED module inside the incandescent bulb while maintaining the external shape of the incandescent bulb and efficiently dissipating the heat generated from the LED module and the power supply unit to the outside.

The detailed description below is provided for exemplary purposes only, and merely illustrates an exemplary embodiment of the present disclosure. In addition, the principle and concept of the present disclosure are provided for the most useful and easy to explain purposes.

Therefore, it is not intended to provide a more detailed structure than necessary for basic understanding of the present disclosure, and various forms that may be implemented in the substance of the present disclosure by those of ordinary skill in the art are illustrated through the drawings.

Hereinafter, the configuration and operation of an exemplary embodiment of the present disclosure will be described in detail with reference to the accompanying drawings.

Figure 1:
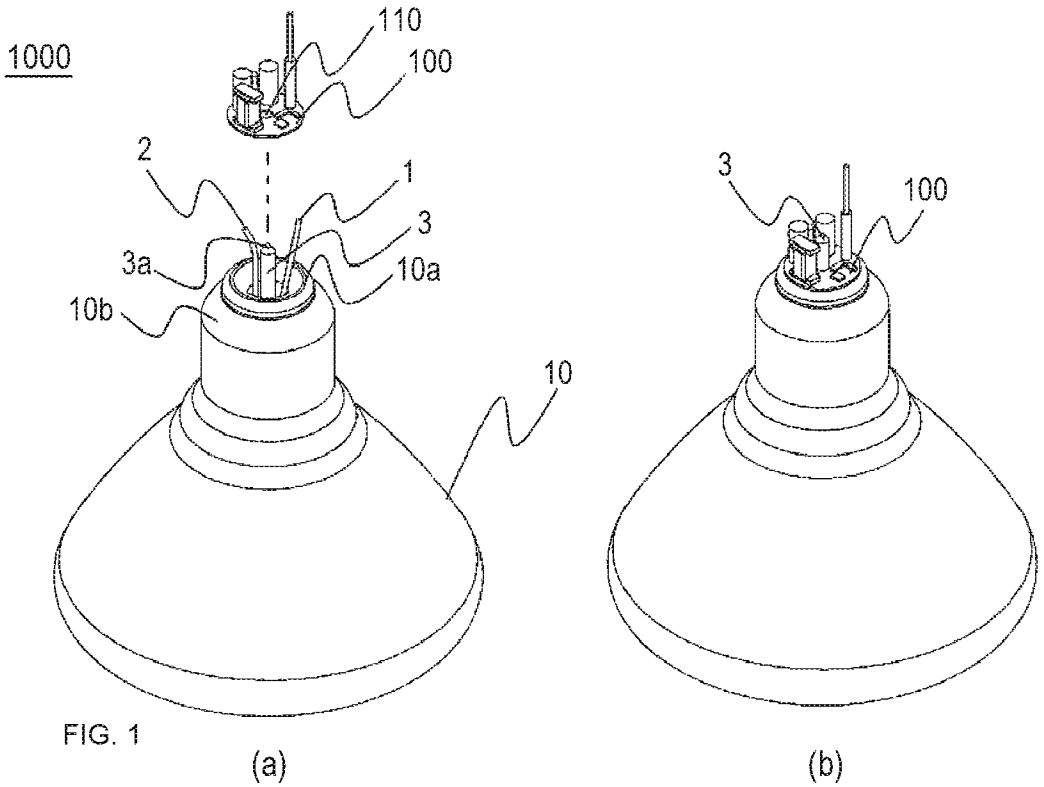
FIGS. 1 and 2 are perspective views illustrating a manufacturing process of an incandescent bulb-type LED lamp having a heat dissipation function according to an exemplary embodiment of the present disclosure.
Figure 2:
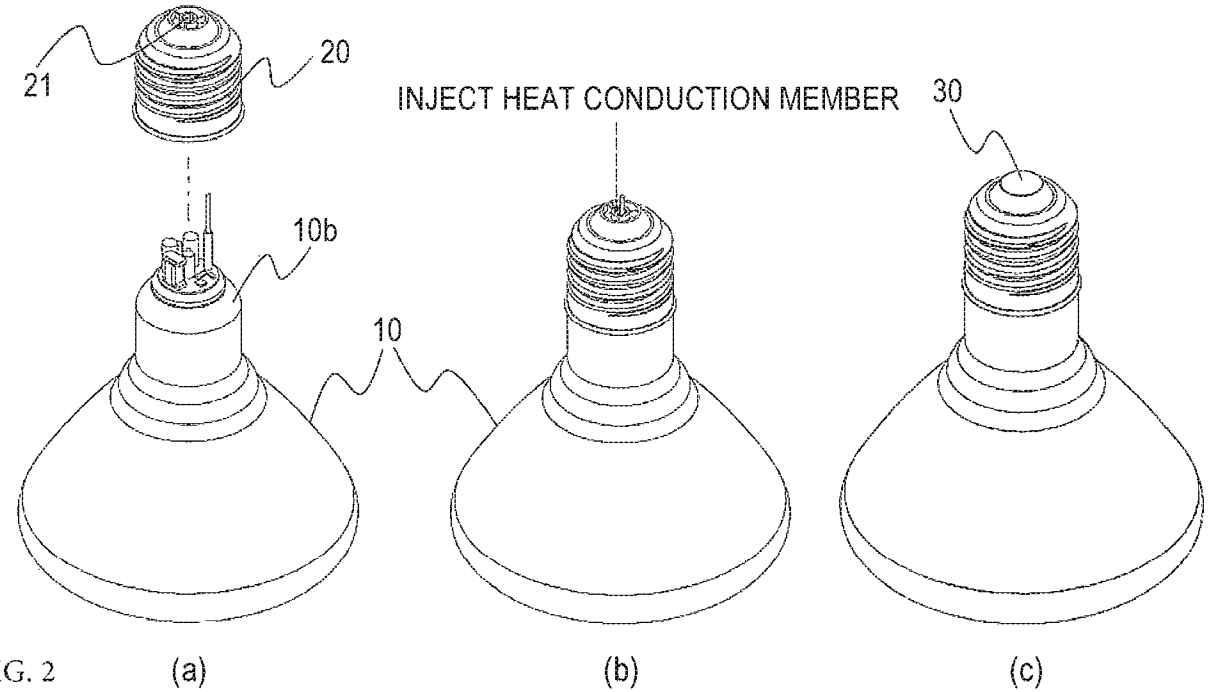

FIGS. 1 and 2 are perspective views illustrating a manufacturing process of an incandescent bulb-type LED lamp having a heat dissipation function according to an exemplary embodiment of the present disclosure, and FIGS. 3A, 3B, 4 and 5 are cross-sectional views illustrating a manufacturing process of an incandescent bulb-type LED lamp having a heat dissipation function according to an exemplary embodiment of the present disclosure.

Referring to FIGS. 1 to 5, an LED lamp 1000 includes a globe 10 forming an external shape of the lamp, an LED module 120 supported by a stem 4 and installed inside the globe, a power supply unit 100 for supplying electricity to the LED module 120, a base 20 that is bonded to one side of the globe and connected to a socket to supply commercial power to the power supply unit, and a heat conduction member 300 that is filled in an internal space of the base and configured to dissipate heat generated from the LED module and the power supply unit to the outside through the base.

The globe 10 is formed of a glass sphere or a plastic sphere, and may be formed in various shapes such as an R-type, an elliptical reflection type, a PAR type, a bowl reflection type, and the like, depending on a light distribution direction in which light emitted from the LED module 120 is focused or spread. The globe 10 may be formed in one integrated shape in which an internal space is separated from an external space. The globe 10 may be formed by inserting the stem 4 for supporting the LED module into an opening portion of a predetermined glass sphere, and then bonding a portion of the opening and a portion of the stem 4, and such a bonding surface may then become a bonding surface 10*a* on which the power supply unit 100 is seated. In addition, a portion of the globe 10 may form a base bonding surface 10*b* to which the base 20 may be bonded. A bar-shaped pillar having a predetermined length may be formed in the center of the stem 4, and a gas injection portion 3 for injecting a predetermined gas into the globe 10 may be formed in the center of the pillar. In addition, the stem 4 may be connected to a lower lead-in wire 5 and an upper lead-in wire 6 for supporting the LED module 120, and a + wire 1 and a – wire 2 may be connected to the lower lead-in wire 5 and the upper lead-in wire 6, respectively, to supply electricity to the LED module 120.

Therefore, the globe 10 connected to the stem 4 may have a single integrated shape, and a space completely blocked from the outside may be formed inside the globe by sealing a gas inlet 3*a* after a predetermined gas is injected through the gas inlet 3*a*. It should be understood herein that the globe 10 having the single integrated shape means that the inside of the globe is a sealed structure in which air may not flow to the outside and that it is not structured in such a way that the glass sphere or the plastic sphere is separated from a predetermined portion and the respective separated portions are connected by fitting, screwing, and the like.

On the other hand, in order to increase the heat transfer efficiency toward a glass sphere surface or the base 20 through internal convection of the heat emitted from the LED module, the predetermined gas injected into the globe 10 may be a single gas, such as helium, nitrogen, or argon, or a mixed gas thereof.

After the stem 4 to which the LED module 120 is connected is bonded to the globe 10, the power supply unit 100 is seated on the bonding surface 10*a* of the inlet side of the globe 10 so that the power supply unit 100 may be bonded to the globe 10. The power supply unit 100 may be formed as a printed circuit board (PCB) on which predetermined electronic components are mounted for converting commercial power applied through the + wire 1 and the – wire 2 connected to the base into direct current that may drive the LED module. The power supply unit 100 may be formed with a gas injection hole 110 through which the gas injection portion 3 penetrates in the center of the printed circuit board (PCB). After the power supply unit 100 is connected to the globe 10, an end portion of the base 20 is bonded to the base bonding surface formed on the side of the globe, so that the base 20 and the globe 10 may be bonded. Accordingly, an internal space S formed by an inner surface of the base 20 and the printed circuit board (PCB) of the power supply unit 100 is formed, and the internal space is filled with air (atmosphere).

On the other hand, the LED lamp has a problem in that durability is significantly reduced by the heat generated from the LED module and the power supply for driving the LED module. In addition, when a large amount of current needs to flow through the power supply to increase illumination, the durability problem due to the heat becomes more serious. In particular, when the globe has one integrated shape (e.g., incandescent bulb shape) as in the present disclosure, the heat generated from the LED module inside the globe is inevitably dissipated to the surface of the glass sphere by convection or transferred to the power supply unit 100, and the heat emitted from the power supply unit 100 is inevitably moved to the surface of the base due to thermal convection inside the base and then dissipated. Therefore, the power supply unit 100 that has received the heat generated from the LED module is more affected by the heat, and wire breakage, defective electronic components, and the like may occur. Therefore, it will be almost impossible to secure durability in the LED lamp having such a sealed structure.

According to the present disclosure, such a problem may be solved by filling the internal space S with the heat conduction member 300 in order to maximally dissipate the heat generated from the LED module and the power supply through the base 20 by heat conduction rather than thermal convection. The heat conduction member 300 may be made of, but not limited to, heat dissipating silicon and may be made of various heat conduction materials that may be filled by being injected into a predetermined space in a paste form. That is, the heat dissipated from the LED module and the power supply unit may be immediately conducted to the heat transfer member in contact with the substrate of the power supply unit and each of the components, and may be maximally dissipated toward the base. Therefore, in the incandescent bulb-type LED lamp according to the present disclosure having a high-efficiency heat dissipation function, the durability of the LED lamp of the sealed structure may be improved, and the production cost may be reduced by not using an expensive heat dissipation device for a portion of the conventional globe. In addition, since the production equipment for manufacturing the conventional incandescent bulb including the globe, stem and base may be used as it is, additional process costs may not incur, thereby improving the production efficiency.

The heat conduction member 300 may be injected through a syringe or a dispenser through the opening 21 formed in the upper portion of the base, after the base 200 is bonded to the globe 10. The LED lamp 1000 may be completed by closing the opening 21 and at the same time connecting a closing cap 30 connected to a contact point of the socket to the upper portion of the base, after the internal space S of the base is filled with the heat conduction member 300. The closing cap 30 may be a rivet made of a conductive material.

On the other hand, in order to prevent the heat conduction member 300 from flowing into a gap between the gas injection hole 110 and the gas injection portion 3 formed in the printed circuit board (PCB) when filling the internal space S of the base with the heat conduction member 300, a sealing member for filling the gap formed between the gas injection hole 110 and the gas injection portion 3 formed in the printed circuit board (PCB) may be inserted. The sealing member may include, but not limited to, an O-ring (see 320 in FIG. 4) and may be made of various sealants such as paste-type silicone or rubber material for filling the gap formed between the gas injection hole and the gas injection portion.

Figure 3A:
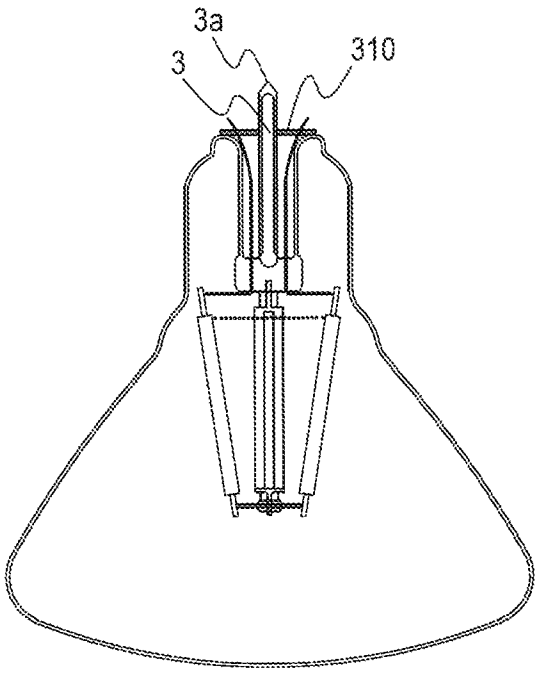
FIGS. 3A, 3B, 4 and 5 are cross-sectional views illustrating a manufacturing process of an incandescent bulb-type LED lamp having a heat dissipation function according to an exemplary embodiment of the present disclosure.
Figure 3A:
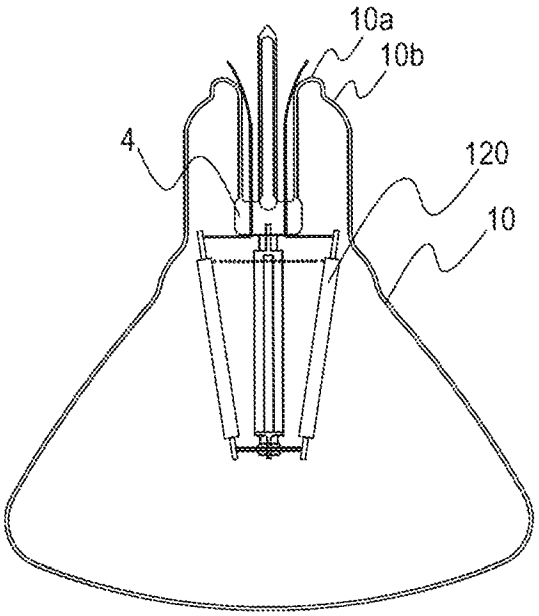
Figure 3B:
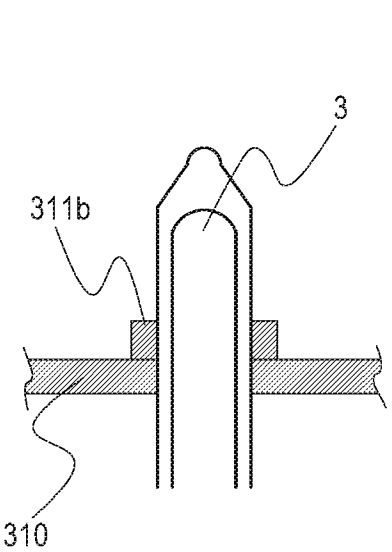
Figure 3B:
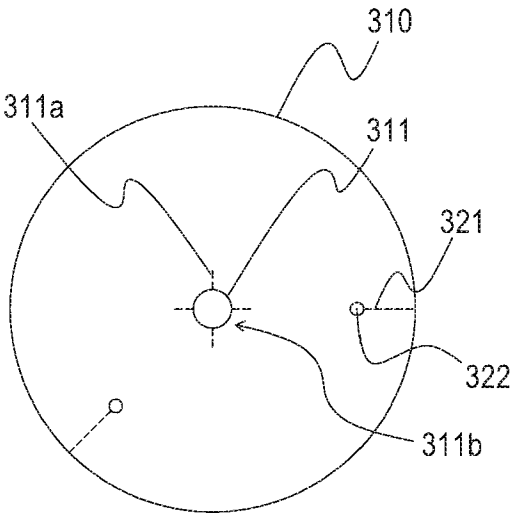
Figure 4:
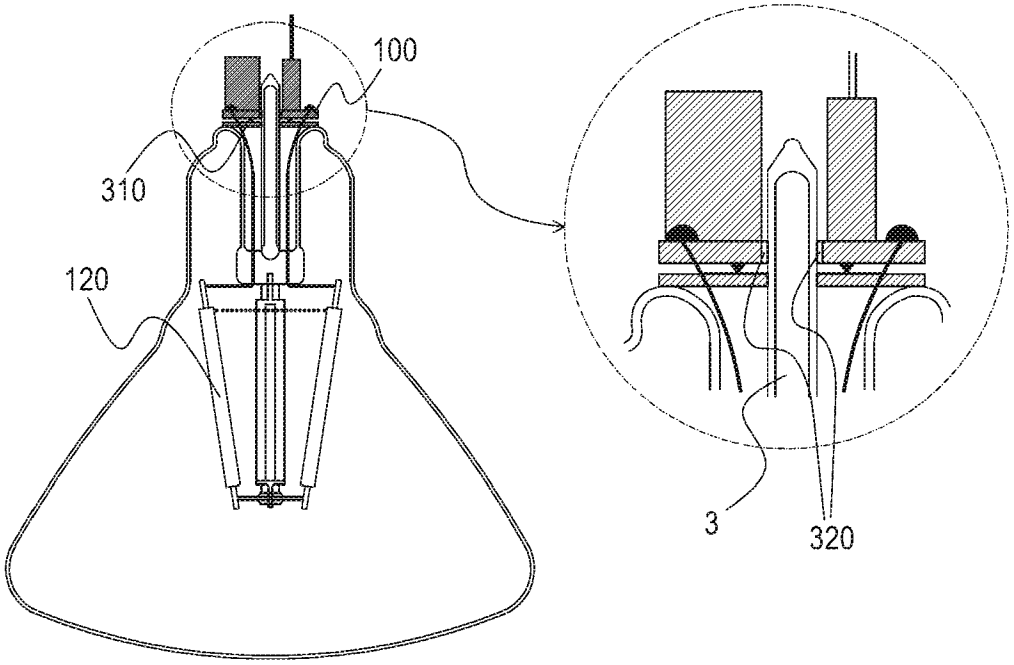
Figure 5:
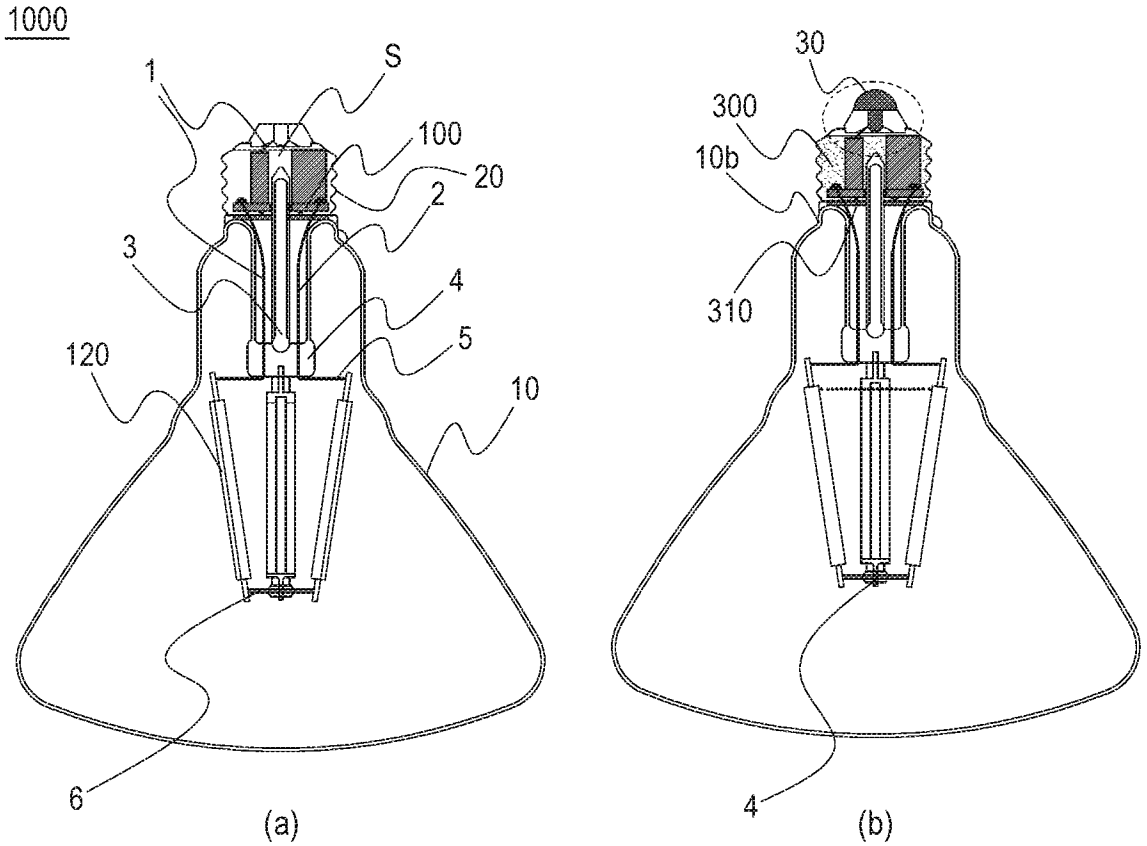

On the other hand, referring to (b) of FIG. 3A and FIG. 3B, before bonding the power supply unit 100 to the bonding surface 10*a*, an insulating sheet 310 through which the + wire and the − wire penetrate may be bonded thereto. The insulating sheet 310 may support the + and − wires connected to the printed circuit board (PCB) of the power supply unit so that the + and − wires do not move, thereby preventing a short circuit due to a contact between a soldering part of the printed circuit board (PCB) and the + and − wires during the manufacturing process of the LED lamp. Two support holes 322 may be formed in the insulating sheet 310 to support the + wire and the − wire, and one side of the support hole 322 may be connected to an edge of the insulating sheet 310 by a cut-out line 321. Therefore, each of the + wire and the − wire may be supported by the insulating sheet 310 by being guided along the cut-out line 321 from the edge of the insulating sheet 310 and seated in the support hole 322.

In addition, a hole 311 into which the gas injection portion 3 is inserted may be formed in the center of the insulating sheet 310, and one or more cut-out lines 311*a* may be formed in predetermined directions from the hole 311. A diameter of the hole 311 is formed smaller than a diameter of the gas injection portion 3 by a predetermined length, so that the cut-out line 311*a* is cut while the gas injection portion 3 is inserted into the hole 311, and a cut-out plate 311*b* thus formed may be attached to an outer surface of the gas injection portion 3. The cut-out plate 311*b* attached to the outer surface of the gas injection portion 3 may prevent the heat conduction member from flowing into the globe when the heat conduction member is filled. The insulating sheet 310 may be made of a flame retardant material such as polycarbonate having excellent strength, heat resistance, and transparency. Only any one or both of the insulating sheet 310 and the sealing member for preventing the heat conduction member from penetrating into the globe when the heat conduction member is filled may be applied to the LED lamp.

Hitherto, the present disclosure has been described in detail through representative exemplary embodiments, but those of ordinary skill in the art to which the present disclosure pertains will understand that various modifications may be made to the above-described exemplary embodiments without departing from the scope of the present disclosure.

Therefore, the scope of the present disclosure should not be limited to the described exemplary embodiments but should be defined by the claims appended below as well as their equivalents.

What is claimed is:

1. An incandescent bulb-type LED lamp having a heat dissipation function, the incandescent bulb-type LED lamp comprising:

a globe forming an external shape of the lamp;

an LED module supported by a stem in which a gas injection portion is formed and installed inside the globe;

a power supply unit configured to supply power to the LED module;

a base bonded to one side of the globe and connected to a socket to supply commercial power to the power supply unit; and a heat conduction member filled in an internal space formed by an inner surface of the base and a printed circuit board (PCB) of the power supply unit, the heat conduction member configured to dissipate heat generated from the LED module and the power supply unit to the outside through the base, wherein the heat conduction member is injected through an opening formed in an upper portion of the base after the base is bonded to the globe.

2. An incandescent bulb-type LED lamp having a heat dissipation function, the incandescent bulb-type LED lamp comprising:

a globe forming an external shape of the lamp;

an LED module supported by a stem in which a gas injection portion is formed and installed inside the globe;

a power supply unit configured to supply power to the LED module;

a base bonded to one side of the globe and connected to a socket to supply commercial power to the power supply unit; and a heat conduction member filled in an internal space formed by an inner surface of the base and a printed circuit board (PCB) of the power supply unit, the heat conduction member configured to dissipate heat generated from the LED module and the power supply unit to the outside through the base, wherein the heat conduction member is made of heat dissipating silicon.

3. An incandescent bulb-type LED lamp having a heat dissipation function, the incandescent bulb-type LED lamp comprising:

a globe forming an external shape of the lamp;

an LED module supported by a stem in which a gas injection portion is formed and installed inside the globe;

a power supply unit configured to supply power to the LED module;

a base bonded to one side of the globe and connected to a socket to supply commercial power to the power supply unit; and a heat conduction member filled in an internal space formed by an inner surface of the base and a printed circuit board (PCB) of the power supply unit, the heat conduction member configured to dissipate heat generated from the LED module and the power supply unit to the outside through the base, wherein the PCB of the power supply unit is formed with a gas injection hole into which the gas injection portion is inserted, and wherein a sealing member is inserted between the gas injection portion and the gas injection hole of the PCB.

4. The incandescent bulb-type LED lamp of claim 1, further comprising an insulating sheet supporting a + wire and a − wire between the power supply unit and a bonding surface, wherein a hole into which the gas injection portion is inserted is formed in the center of the insulating sheet, and one or more cut-out lines are formed in predetermined directions from the hole such that a cut-out plate is attached to an outer surface of the gas injection portion while the gas injection portion is inserted into the hole.

* * * * *